US006191769B1

(12) United States Patent
Fujiwara et al.

(10) Patent No.: US 6,191,769 B1
(45) Date of Patent: Feb. 20, 2001

(54) LIQUID CRYSTAL DISPLAY DEVICE

(75) Inventors: Hisao Fujiwara; Haruhiko Okumura, both of Kanagawa-ken (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/135,858

(22) Filed: Aug. 18, 1998

(30) Foreign Application Priority Data

Aug. 29, 1997 (JP) ..... 9-235098

(51) Int. Cl.[7] ..... G09G 3/36
(52) U.S. Cl. ..... 345/99; 345/94; 345/96
(58) Field of Search ..... 345/87, 58, 94, 345/96, 98, 99, 100, 208, 209

(56) References Cited

U.S. PATENT DOCUMENTS 5,430,458 * 7/1995 Weber ..... 345/60
5,790,092 * 8/1998 Moriyama ..... 345/96
5,963,189 * 10/1999 Ito et al. ..... 345/100
5,986,631 * 11/1999 Nanno et al. ..... 345/94
6,121,950 * 9/2000 Zavracky et al. ..... 345/98

FOREIGN PATENT DOCUMENTS 8-292419 11/1996 (JP) .

OTHER PUBLICATIONS

Juerg Fuenfschilling, et al., "Physics and Electronic Model of Deformed Helix Ferroelectric Liquid Crystal Displays", Japanese Journal of Applied Physics, vol. 33, No. 9A, Part 1, Sep. 1994, pp. 4950–4959.

* cited by examiner

*Primary Examiner*—Kent Chang
(74) *Attorney, Agent, or Firm*—Oblon, Spivak, McClelland, Maier & Neustadt, P.C.

(57) ABSTRACT

The liquid crystal display device has at least a liquid crystal panel, a signal line driver for driving signal lines in the liquid crystal panel, and a scanning line driver for driving scanning lines. To prevent waveform distortion due to a high output impedance of the signal line driver from causing adverse effects on a displayed image, a control means is provided which causes display signals to be written to pixel electrodes in the liquid crystal panel so as to avoid amplitude variation periods of the display signals. According to a preferred embodiment, the control means consists of a display signal delay circuit, a scanning signal delay circuit, and a display timing controller that control the signal line driver and the scanning line driver.

7 Claims, 9 Drawing Sheets

LIQUID CRYSTAL DISPLAY DEVICE

BACKGROUND OF THE INVENTION

1. Field of the Invention

The present invention relates to a liquid crystal display device having a driving method in which the polarities of signal potentials are inverted when they are written to the pixel electrodes.

2. Description of the Related Art

A driving method of a liquid crystal display device that is commonly employed conventionally will be described with reference to FIGS. 10–12.

FIG. 10 shows a liquid crystal display device system and polarities of display signals that are written to a display panel 1 of the system. Reference numerals 2 and 3 denote a signal line driver and a scanning line driver, respectively. Reference numeral 4 denotes a display timing controller for controlling the signal line driver 2 and the scanning line driver 3. FIG. 11 shows, in the forms of two-dimensional pictures, (n−1)th-field and nth-field display signals in FIG. 10. In the picture of the (n−1)th field, plus signals and minus signals are written alternately from the first line to the nth line. In the next, nth field, the polarity of the lth-line signal is changed from plus to minus.

FIGS. 12A and 12B show an output signal of the signal line driver 2 and output signals of the scanning line drivers 3 in the nth field, respectively. In FIG. 12A, signals shown above the chain line are display signals of positive polarity and those shown below the chain line are display signals of negative polarity. As shown in FIG. 12A, negative-polarity (minus) signals are output continuously for the lth line for which the polarity is changed from the (n−1)th field and for the lines before and after it, that is, the (1−1)th and (1+1)th lines. Therefore, for the lth line and the (1+1)th line, the display signals have no rising portion from the lowest potential; that is, they have no voltage transient period. Therefore, the amplitude of the final potential in those scanning lines is larger than that in other scanning lines by ΔVsig [V]. As a result, in the lth line and the (l +1)th line, display signals having a larger amplitude by ΔVsig [V] are written and hence brighter display is effected than in other scanning lines. The increase of ΔVsig [V] in signal amplitude results from the driving ability of the signal line driver 2, particularly its output impedance.

FIG. 12A also shows, by a broken line, an output signal of an ideal signal line driver whose output impedance is zero. In this case where the output impedance is zero, the polarity inversion of the signal is completed instantaneously and the final value of the signal amplitude is kept constant irrespective of whether portions of the same polarity exist; there occurs no problem in display. However, actually, since the driver 2 has a certain, non-zero output impedance value, a low-pass filter is formed by a parasitic capacitance in the liquid crystal panel 1 and the output impedance of the driver 2, which causes a problem that waveform distortion occurs as indicated by the continuous line and a flicker occurs on the display screen.

SUMMARY OF THE INVENTION

As described above, in conventional liquid crystal display devices, signal writing is performed continuously to pixels for which polarity inversion is effected with respect to the preceding field and to pixels for the next signal writing. Since pixels for which polarity inversion is effected with respect to the preceding field and pixels for the next signal writing are continuously given signals of the same polarity, waveform distortion of signal voltages due to the output impedance of the signal line driver causes a problem that the luminance increases or decreases improperly or a flicker occurs on the display screen.

The present invention has been made in view of the above problem, and an object of the invention therefore to provide a liquid crystal display device capable of displaying high-quality images that are free of such undesirable phenomena as improper increase or decrease in luminance and a flicker on the display screen by preventing waveform distortion of display signals that is caused by a high output impedance of the signal line driver from causing adverse effects by controlling the writing of display signals to the pixel electrodes so as to avoid amplitude variation periods of the display signals.

To attain the above object, the invention provides a liquid crystal display device comprising a plurality of signal lines and a plurality of scanning lines that are arranged in lattice form; pixel electrodes that are arranged in matrix form at crossing portions of the signal lines and the scanning lines, a display voltage being written to each of the pixel electrodes from one of the signal lines electrically connected thereto in a display voltage writing state that is established when a corresponding one of the scanning lines is selected; an counter electrode that is opposed to the pixel electrodes; a liquid crystal layer provided between the pixel electrodes and the counter electrode; a signal line driver for sequentially transferring display voltages having alternate polarities to the signal lines; a scanning line driver for selectively driving the scanning lines to thereby allow display voltages to be written to part of the pixel electrodes corresponding to a selected scanning line; and control means for causing, when a polarity of display voltages to be supplied to a particular one of the signal lines in one field or frame is opposite to a polarity of display signals that were supplied to the same signal line in a preceding field or frame, the signal line driver to supply display voltages to pixel electrodes corresponding to a next signal line after inserting a dummy cycle having a predetermined interval.

From another point of view, the control means is means for causing the display signal driver to insert a dummy cycle to thereby supply stabilized output voltages having continuity polarity inversion cycle when the display signal driver supplies display voltages having the same polarity as in a preceding field to pixel electrodes corresponding to a first scanning line and supplies display voltages having an inverse to those supplied in the preceding field to pixel electrodes corresponding to a second scanning line that is next to the first scanning line. This liquid crystal display device corresponds to the first and third embodiments.

It is desirable that the predetermined interval be shorter than a time constant of an output impedance of the signal line driver and a parasitic capacitance of one of the signal lines. This is because if the interval is longer than the above time constant, the absolute value of the signal line driver output in the dummy cycle becomes different from that during actual writing, to cause a flicker in a displayed image.

Specifically, to avoid making the control of the entire display system unduly complex, it is desirable that the interval of the dummy cycle be substantially equal to a period necessary for scanning one of the scanning lines.

Wherein the liquid crystal layer is a ferroelectric liquid crystal layer or an antiferroelectric liquid crystal layer, it is desirable that the display voltage writing time for the particular scanning line be longer than that for the next scanning line, or the absolute value of the display voltages for the particular scanning line be larger than that for the next scanning line. This is because where a ferroelectric liquid crystal layer or an antiferroelectric liquid crystal layer is used, large depolarization current requires a sufficiently long writing time or a sufficiently large write voltage.

As for specific hardware of the control means, it is desirable that the control means comprise a scanning signal delay circuit for supplying a scanning signal to the scanning line driver; a display signal delay circuit for supplying a display signal to the signal line driver; and a display timing controller for supplying a scanning signal and a delay signal selection control signal to the scanning signal delay circuit, supplying a display signal and the delay signal selection control signal to the display signal delay circuit, supplying a scanning output prohibition signal to the scanning line driver, and supplying a display polarity inversion control signal to the signal line driver. In particular, it is desirable that the display signal delay circuit comprise a delay circuit and a selection circuit connected to and provided downstream of the delay circuit, and that the scanning signal delay circuit comprise a parallel connection of a delay circuit and a latch circuit, and a selection circuit connected to and provided downstream of the parallel connection of the delay circuit and the latch circuit.

In a liquid crystal display device in which display voltages whose polarities are changed at a rate of one line per field are transferred to the signal lines, the invention provides a configuration in which a dummy cycle is not used. In this case, there is provided control means for causing, when a polarity of display voltages to be supplied to a particular one of the signal lines in one frame is opposite to a polarity of display signals that were supplied to the same signal line in a preceding frame, the signal line driver to start writing to pixel electrodes corresponding to a next signal line after inserting a predetermined intermission period that is long enough for potentials of the signal lines to be stabilized to the second display voltage having approximately the same absolute value as the first display voltage. This liquid crystal display device corresponds to the second and fourth embodiments.

In this case, it is desirable that the writing for the line next to the polarity inversion line be performed after the waveform is stabilized. Therefore, it is desirable that the predetermined intermission period be sufficiently long, that is, longer than a time constant of an output impedance of the signal line driver and a parasitic capacitance of one of the signal lines.

As for specific hardware of the control means, it is desirable that the control means comprise a scanning signal delay circuit for supplying a scanning signal to the scanning line driver; a display signal delay circuit for supplying a display signal to the signal line driver; and a display timing controller for supplying a scanning signal and a delay signal selection control signal to the scanning signal delay circuit, supplying a display signal and the delay signal selection control signal to the display signal delay circuit, supplying a scanning output prohibition signal to the scanning line driver, and supplying a display polarity inversion control signal to the signal line driver. In particular, it is desirable that the display signal delay circuit comprise a delay circuit and a selection circuit connected to and provided downstream of the delay circuit, and that the scanning signal delay circuit comprise a parallel connection of a delay circuit and a latch circuit, and a selection circuit connected to and provided downstream of the parallel connection of the delay circuit and the latch circuit.

DETAILED DESCRIPTION OF THE PREFERRED EMBODIMENTS

The details of the present invention will be hereinafter described by using illustrated embodiments.

EMBODIMENT 1

Figure 1A:
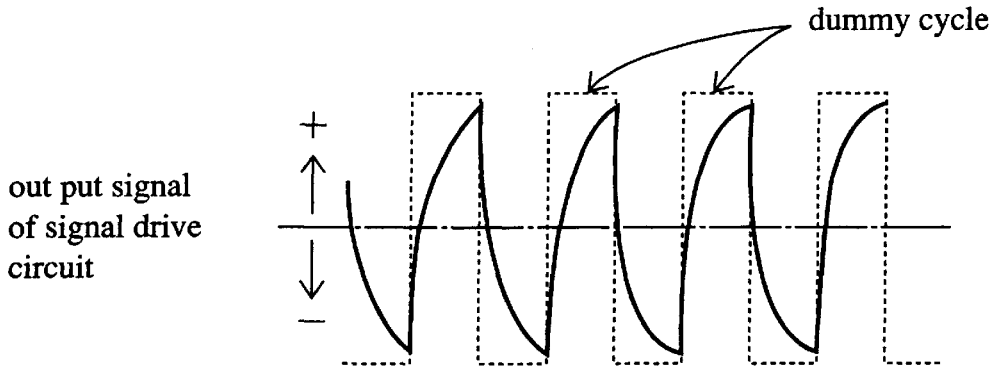
FIGS. 1A and 1B show signal waveforms according to a first embodiment of the present invention.
Figure 1B:
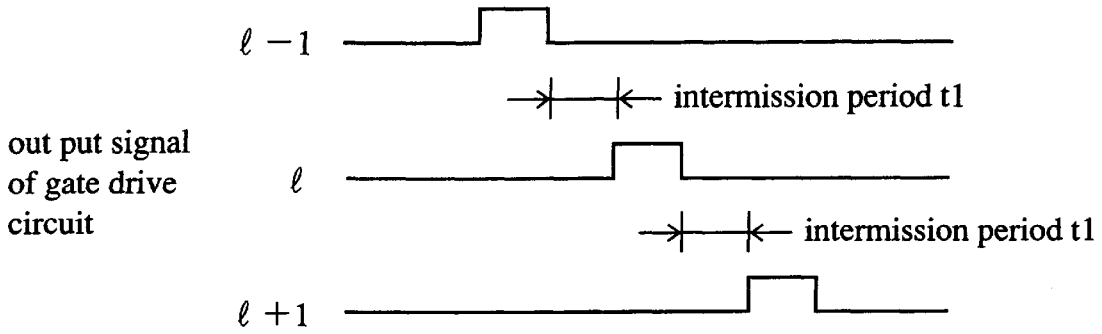

FIG. 1 shows signal waveforms according to a first embodiment of the invention. Specifically, FIG. 1A shows an output signal of a signal line driver and FIG. 1B shows output signals of a scanning line driver (i.e., gate driver). While conventionally write periods for the lth line for which the polarity is changed from the preceding field and for the lines before and after it, that is, the (l−1)th and (l+1)th lines, are continuous, in this embodiment intermission periods t1 are inserted in between. By virtue of the inserted intermission periods t1 and inverted signals (dummy cycles) for quasi-polarity-inverted driving, there occurs no increase in signal amplitude corresponding to ΔVsig [V] that conventionally occurs between the lth line (polarity inversion line) and the (l+1)th line. In other words, by inserting the dummy cycles, the writing of display signals to the pixel electrodes the lth line (polarity inversion line) and the (l+1)th line can be performed by using stable output signals of a signal line driver that have no variation in frequency (conventionally, because of absence of dummy cycles, the polarity inversion cycle is longer in writing for the lth and (l+1)th lines). As a result, unintended increase in signal amplitude can be prevented, whereby improper increase in luminance can be prevented and the frequency of occurrence of flickers on the display screen can be reduced.

Figure 2:
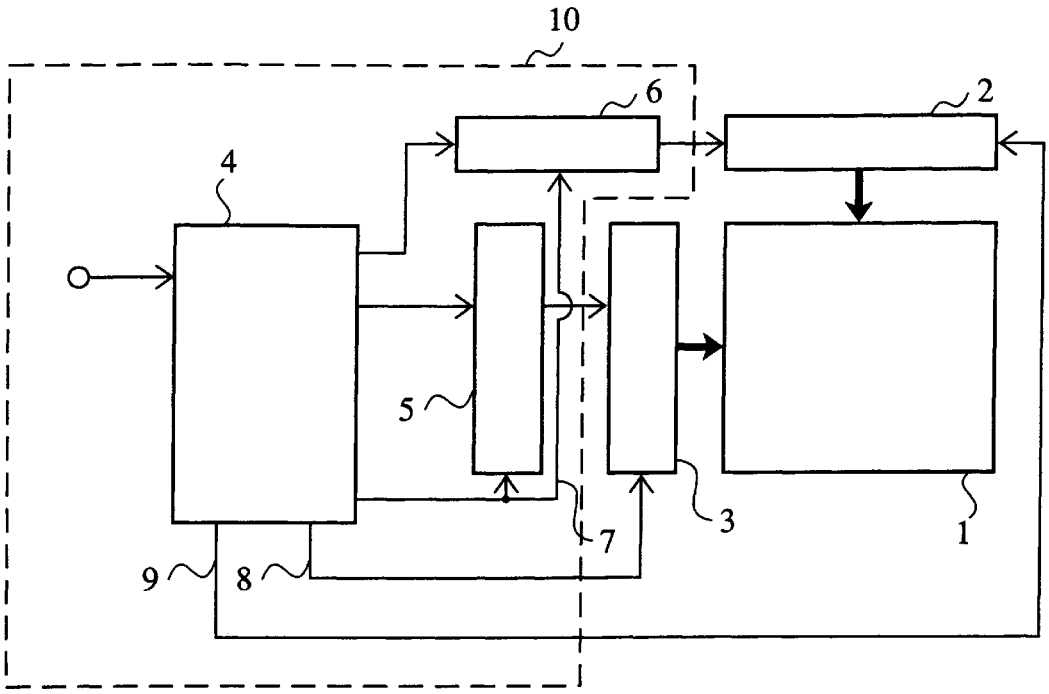
FIG. 2 shows a liquid crystal display device system according to the first embodiment.

FIG. 2 shows an example configuration of a liquid crystal display device for producing display signals in which and dummy cycles (intermission periods) are inserted. Based on a display signal that is input to the liquid crystal display device, a display timing controller 4 generates a basic timing signal for allowing operation of a signal line driver 2 and a scanning line driver 3. The display timing controller 4 further generates drive control signals such as a scanning output prohibition signal 8 for on/off-controlling output signals of the scanning line driver 3 and a display polarity inversion control signal 9 for controlling polarities of display signals of the signal line driver 2. Still further, the display timing controller 4 generates a display signal and a scanning signal for displaying an image on a display panel 1, to produce outputs of the signal line driver 3 and outputs of the scanning line driver 2 that correspond to each other as shown in FIGS. 1A and 1B. The display signal that is output from the timing controller 4 is subjected to delay of the intermission period in a display signal delay circuit 6, and a resulting display signal is supplied to the signal line driver 2.

Figure 3:
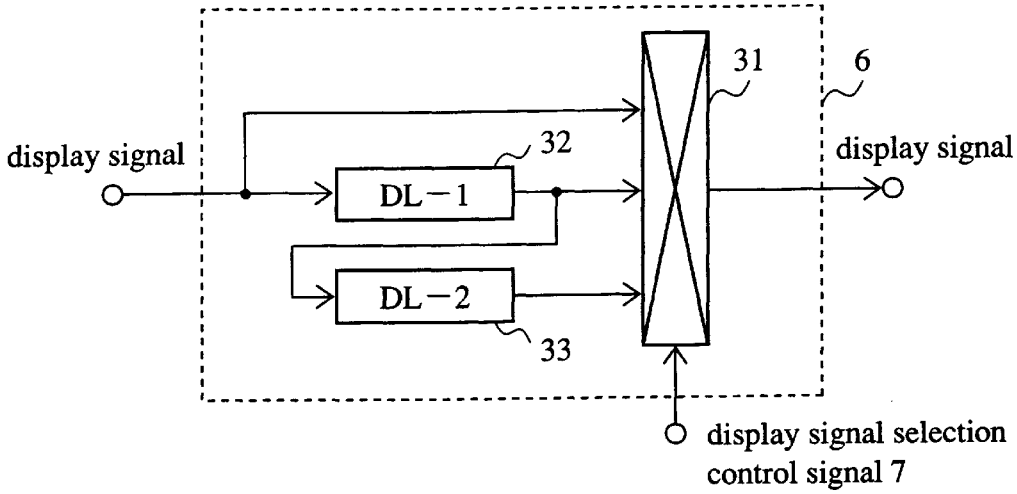
FIG. 3 shows the details of a part of the liquid crystal display device system according to the first embodiment.

FIG. 3 shows a configuration of the display signal delay circuit 6. In the display signal delay circuit 6, based on a display signal selection control signal 7 supplied from the display timing controller 4, a selection circuit 31 outputs a display signal without any delay until insertion of an intermission period tl (see FIG. 1B), that is, until a time point corresponding to the (l−1)th line. For the lth line, based on the display signal selection control signal 7, the selection circuit 31 outputs a display signal that has been delayed by a delay circuit 32 by the intermission period. Similarly, for the (l+1)th line, a display signal obtained by further delaying a display signal that is output from the delay circuit 32 by a delay circuit 33 by the intermission period is supplied to the signal line driver 2. The signal line driver 2 receives the display signal that is delayed by the intermission period(s) from the display signal delay circuit 6 and the display polarity inversion control signal 9 from the display timing controller 4. The display polarity inversion control signal 9 serves to perform a polarity control in such a manner that display signals are applied from the signal line driver 2 to the liquid crystal panel 1 while their polarities are inverted at a rate of one scanning line per field, and to realize the dummy cycles (intermission periods) shown in FIG. 1A.

Figure 4:
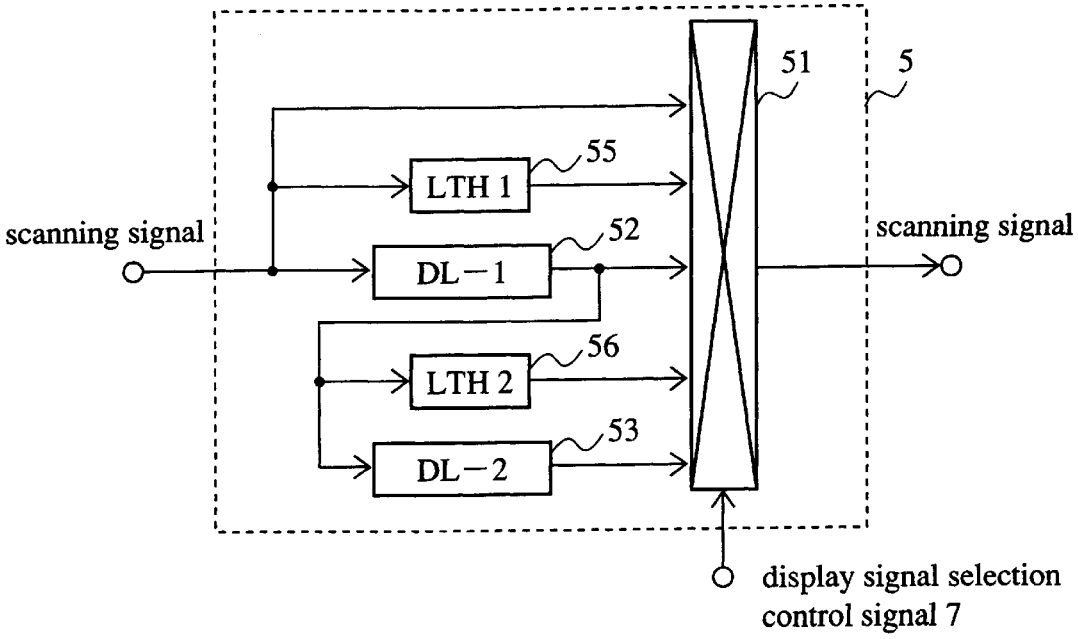
FIG. 4 shows the details of another part of the liquid crystal display device system according to the first embodiment.

FIG. 4 shows a configuration of a scanning signal delay circuit 5. Like the display signal delay circuit 3, the scanning signal delay circuit 5 has delay circuits 52 and 53 delays a scanning signal by the same period as the delay circuits 32 and 33, that is, by the intermission period. Therefore, the timing relationship between the display signal and the scanning signal is not changed by the above delaying operation. The scanning signal delay circuit 5 is much different from the display signal delay circuit 6 in that the former has latch circuits 55 and 56 in addition to the delay circuits 52 and 53. The latch circuits 55 and 56 are used because at present in most cases the scanning line driver 3 is configured as a progressive scanning type shift register. That is, if the supply of a clock signal to the scanning line driver 3 is suspended during the intermission periods shown in FIG. 1A, the shift register continues to operate during that period and a delayed display signal does not indicate correct display positions any more. Since the latch circuits 55 and 56 can suspend the scanning operation of the scanning line driver 3, even if the intermission periods are inserted the scanning appears as if to continue from the time point before each intermission period to the time point after it. Outputs of the respective latch circuits 55 and 56 are also output from a selection circuit 51 based on the delay signal selection control signal 7 that is supplied from the display timing controller 4. That is, a scanning signal as received having no delay is selected for the lines up to the (l−1)th line (see FIG. 1B). During the intermission period immediately after the (l−1)th line, a scanning signal without delay that has been latched by the latch circuit 55 is selected. For the lth line, a scanning signal delayed by the delay circuit 52 is selected. During the intermission period immediately after the lth line, a scanning signal that has been delayed by the delay circuit 52 and then latched by the latch circuit 56 is selected. For the (l+1)th line and the following lines, a scanning signal delayed by the delay circuit 53 is supplied to the scanning line driver 3.

The scanning signal driver 3 performs the scanning operation in accordance with a signal supplied from the scanning signal delay circuit 5. During a period when a scanning signal is supplied from the latch circuit 55 or 56 to the scanning line driver 3, that is, during each intermission period, the gates of TFTs as switching elements in the liquid crystal panel 1 are kept on. Therefore, signals for display signal polarity inversion that are supplied from the signal line driver 2 to the liquid crystal panel 1 during each dummy cycle period may be applied to the pixel electrodes, to influence a displayed image. To avoid this problem, during each intermission period, a scanning output prohibition signal 8 for performing a control for outputting potentials to turn off the TFTs is supplied from the display timing controller 4 to the scanning line driver 3. Since the scanning output prohibition signal 8 can force the TFTs in the liquid crystal panel 1 to turn off, no undesirable phenomena due to the dummy cycles or the like do not occur in images displayed on the liquid crystal panel 1. The above-described operation prevents scanning discontinuities in a displayed image due to the insertion of the intermission periods and undesirable phenomena in a displayed image due to the insertion of the dummy cycles. This makes it possible to provide displayed images that are free of deterioration in image quality.

As described above in detail, in the liquid crystal display device according to this embodiment, since the writing of display signals to the pixel electrodes is controlled so that the display signals will not have amplitude variations, waveform distortion of the display signals that is caused by a high output impedance of the signal line driver can be prevented from causing adverse effects. Therefore, improper luminance increase or decrease in a displayed image and other undesirable phenomena can be avoided. It becomes possible to provide a liquid crystal display device capable of displaying high-quality images.

EMBODIMENT 2

Figure 5A:
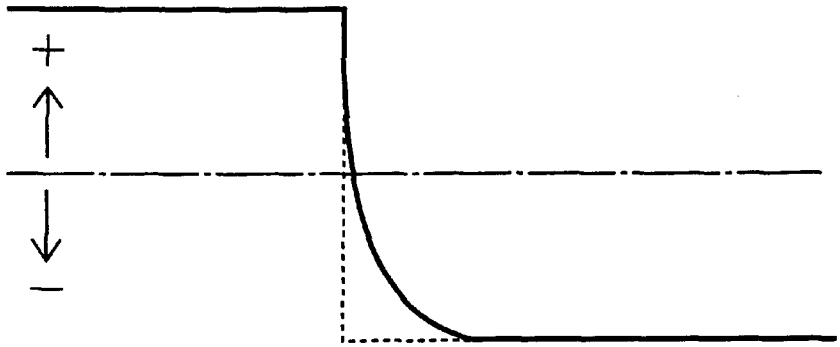
FIGS. 5A and 5B show signal waveforms according to a second embodiment of the invention.
Figure 5B:
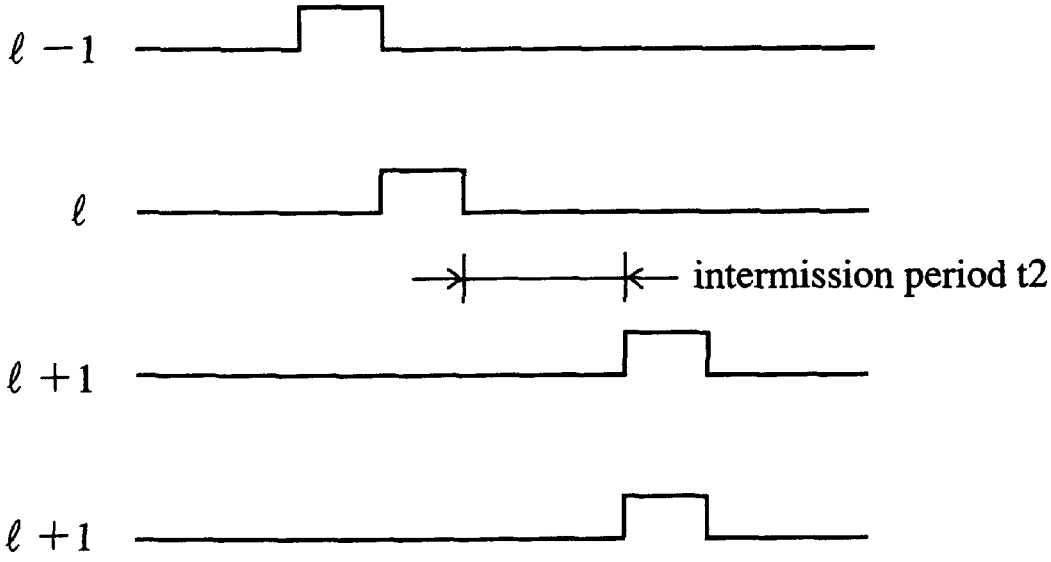

FIGS. 5A and 5B show a signal line driver output signal and scanning line driver output signals, respectively, according to a second embodiment of the invention. The components in the second embodiment that are same as the corresponding components in the first embodiment are given the same reference numerals as in the latter and will not be described in detail. In this liquid crystal display device, as shown in FIG. 5A, display signals that are written to the pixel electrodes have a waveform in which the polarity is continuous, that is, is not inverted, for all scanning lines except one scanning line per field. An intermission period t2 is inserted after the lth line (polarity inversion line). Since the period T of the polarity inversion is larger than the time constant $\tau$ of the output impedance R of the signal line driver and the parasitic capacitance C of a signal line, writing is started when the voltage of the output signal of the signal line driver has reached a value having the same absolute value as and the inverse to the previous value. The intermission period t2 is set longer than the time constant of the output impedance of the signal line driver and the parasitic capacitance of a signal line.

With the above measure, a decrease in signal amplitude corresponding to ΔVsig [V] that conventionally occurs due to waveform distortion on the (l+1)th and (l+2)th lines that follows the lth like (polarity inversion line) does not occur any more. Therefore, in the driving scheme in which display signals to be written have a waveform in which the polarity is continuous, that is, is not inverted, for all scanning lines except one scanning line per field, signal waveform distortion due to a high output impedance of the signal line driver can be prevented from causing adverse effects by inserting the intermission period immediately after display signals have been written to the pixels of the polarity inversion scanning line. Therefore, an undesirable phenomenon of luminance reduction due to signal amplitude decrease that conventionally occurs between the polarity inversion line and other lines can be prevented.

The intermittent operation shown in FIGS. 5A and 5B can be realized by a liquid crystal display device having the configuration shown in FIG. 2. In the case of the intermittent operation of FIGS. 5A and 5B, since only one intermission period is inserted every field, the display signal delay circuit 6 and the scanning signal delay circuit 5 can be made simpler than the intermittent operation of FIGS. 1A and lB.

Figure 6:
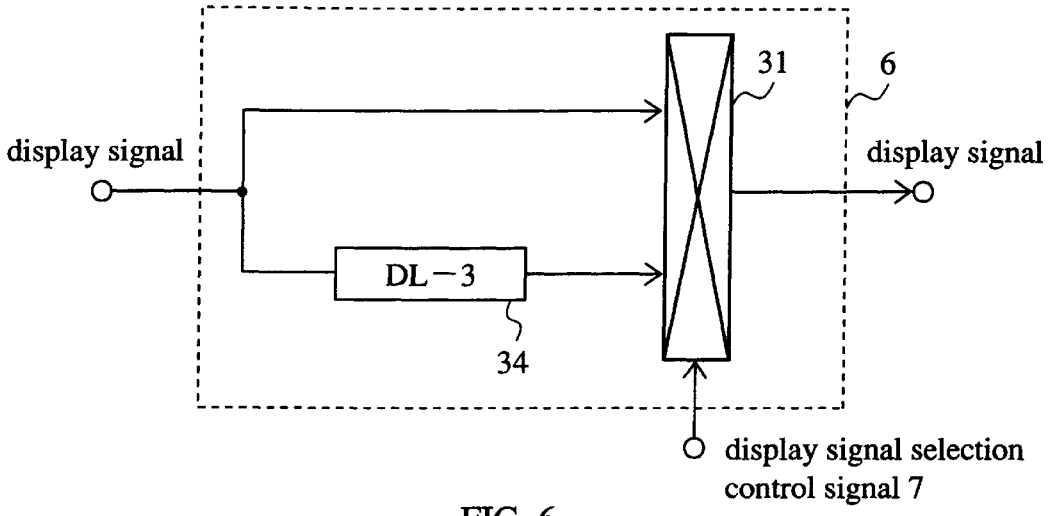
FIG. 6 shows the details of a part of a liquid crystal display device system according to the second embodiment.

FIG. 6 shows a configuration of the display signal delay circuit 6 for realizing the intermittent operation of FIGS. 5A and 5SB. In this case, a selection circuit 51 switches from a display signal without delay to a display signal delayed by a delay circuit 34 at time points before and after the intermission period. The display signal switching control is performed based on the delay signal selection control signal 7 in the same manner as in the case of the display signal delay circuit 6 of FIG. 3.

Figure 7:
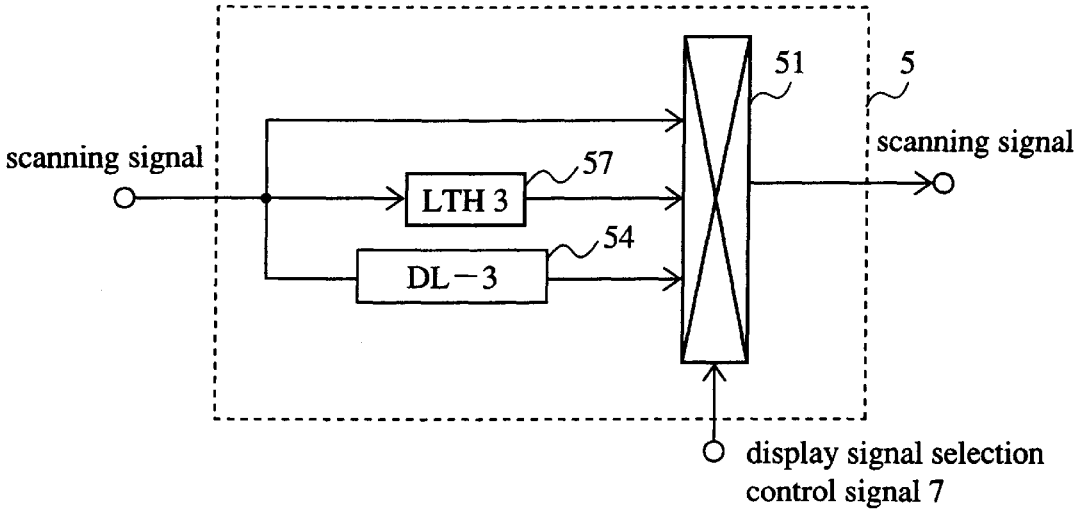
FIG. 7 shows the details of another part of the liquid crystal display device system according to the second embodiment.

FIG. 7 shows a configuration of the scanning signal delay circuit 5 for realizing the intermittent operation of FIGS. 5A and 5B. In this case, the scanning signal switching control is performed based on the delay signal selection control signal 7 in the same manner as in the case of the scanning signal delay circuit 5 of FIG. 4. The intermittent operation can be performed without causing any undesirable phenomena in a displayed image.

Like the first embodiment, the second embodiment can provide a liquid crystal display device capable of displaying images that are free of a flicker.

EMBODIMENT 3

Figure 8A:
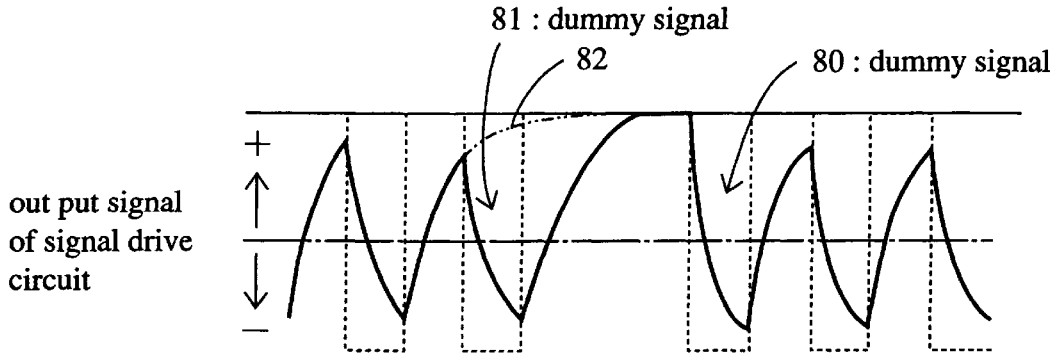
FIGS. 8A and 8B show signal waveforms according to a third embodiment of the invention.
Figure 8B:
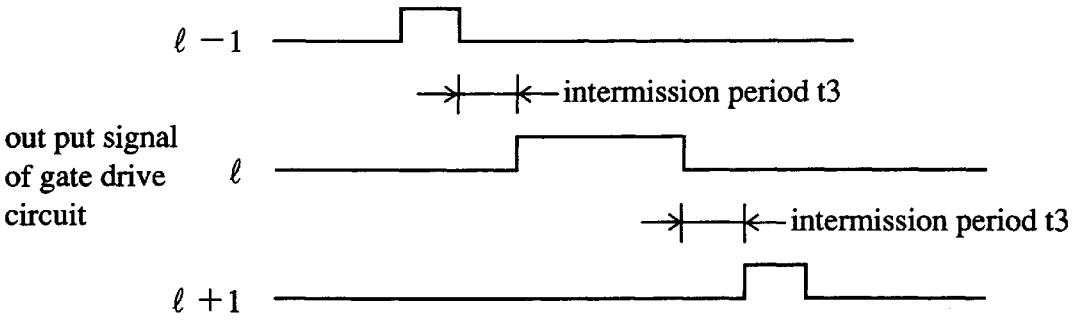

FIGS. 8A and 8B show signal waveforms according to a third embodiment of the invention. This embodiment is much different from the first embodiment in that an antiferroelectric liquid crystal (AFLC) is used as a liquid crystal material. This embodiment is the same as the first embodiment in that a dummy cycle is inserted before writing for the (l+1)th line that is next to the lth line (polarity inversion line) to thereby stabilize the waveform of an output signal of the signal line driver before the writing for the (l+1)th line. However, the write time for the lth line is set longer than in the first embodiment, because in the case of an antiferroelectric or ferroelectric liquid crystal large depolarization current flows at the time of polarity inversion and a resulting reduction in pixel potential may cause insufficient writing.

In the drive waveforms shown in FIGS. 8A and 8B, the write time for the lth line (polarity inversion line) is set longer than for the other lines. By performing writing for the (l+1) th line that is next to the lth line (polarity inversion line) in a state the display signal potential has returned to a value that is approximately equal to a value for the (l−1)th line by virtue of the insertion of a dummy cycle 80, signal waveform distortion due to a high output impedance of the signal line driver can be prevented from causing adverse effects, that is, an undesirable phenomenon of luminance increase due to signal amplitude increase at the lth and (l+1)th lines can be prevented. Further, by setting the write time of a display signal for the lth line (polarity inversion line) longer than for the (l−1)th and (l+1)th lines (and other lines), the problematic phenomenon that reduction in pixel potential due to large depolarization current flowing at the time of polarity inversion may causes insufficient writing which phenomenon is specific to the case where an antiferroelectric liquid crystal (AFLC) is employed can be prevented.

A dummy cycle 81 is not always necessary. Reference numeral 82 denotes an output signal of the signal line driver in a case where the dummy cycle 81 is not inserted. It is an important point that the display signal delay circuit 6 and the scanning signal delay circuit 5 of FIGS. 3 and 4 can still be used for the case where the write time is varied. That is, as for a display signal, the delay of the delay circuit 33 of the display signal delay circuit 6 may be set at a time that is an intermission period t3 plus an elongated portion of the write time. As for a scanning signal, the delay of the delay circuit 53 of the scanning signal delay circuit 5 may be set at a time that is the intermission period t3 plus the elongated portion of the write time. By using such delays, high-quality display images can be obtained.

EMBODIMENT 4

Figure 9A:
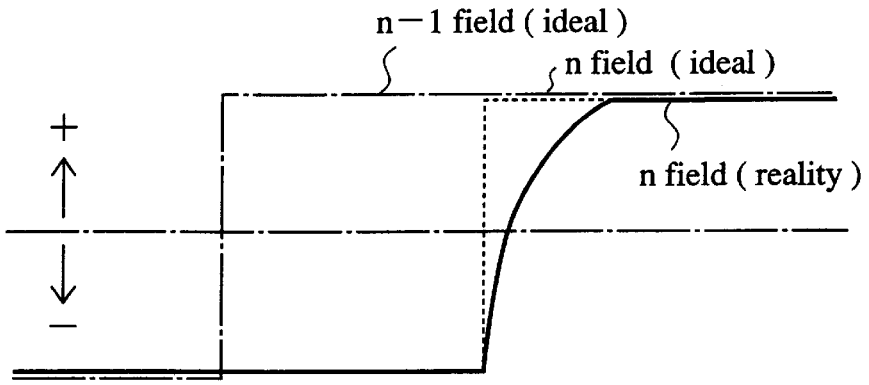
FIGS. 9A and 9B show signal waveforms according to a fourth embodiment of the invention.
Figure 9B:
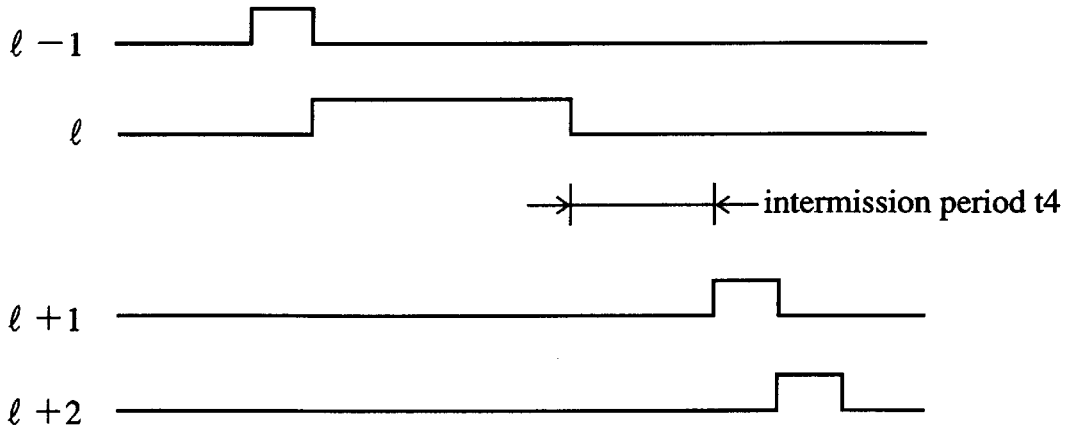
Figure 10:
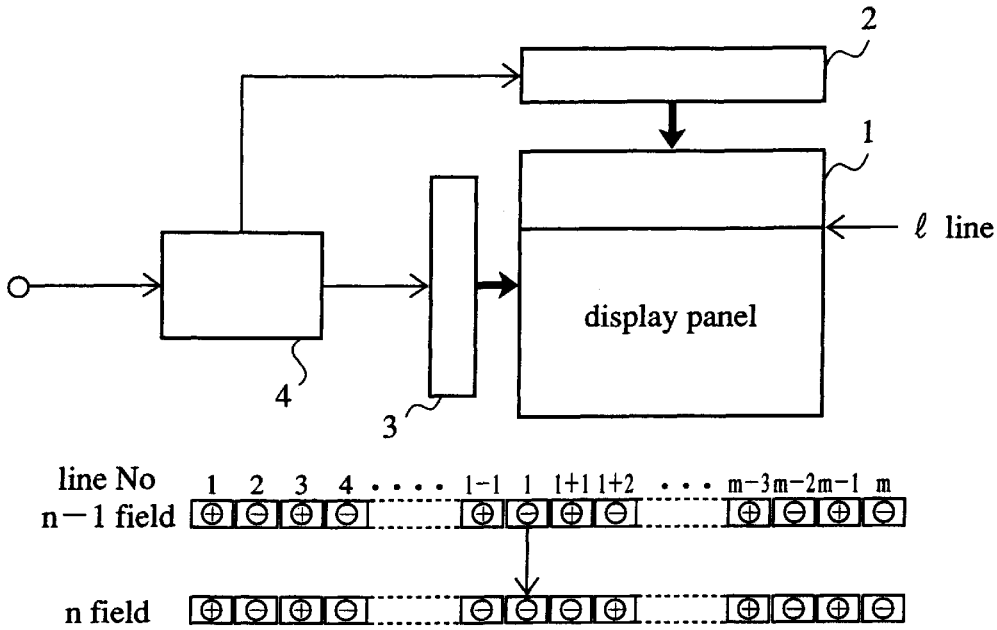
FIG. 10 ( PRIOR ART )
FIG. 10 shows a conventional liquid crystal display device system.
Figure 11:
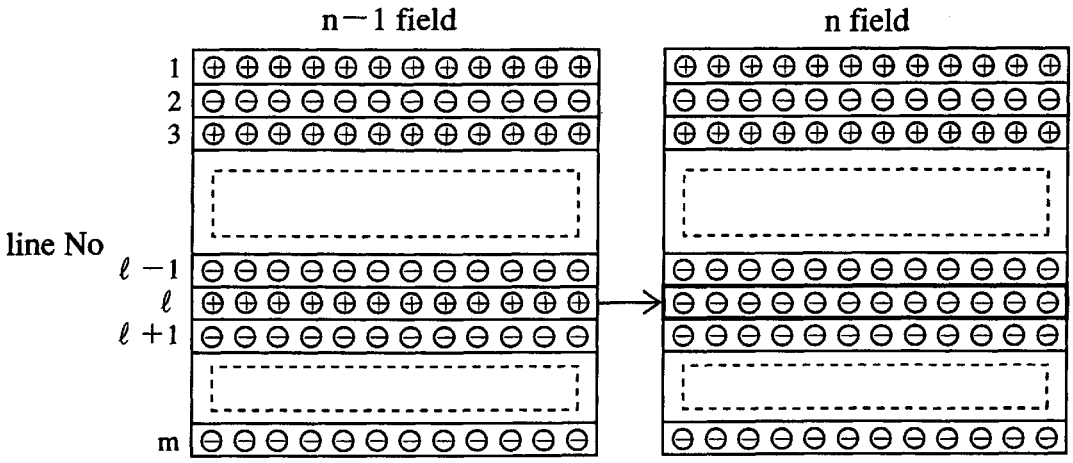
FIG. 11 ( PRIOR ART )
FIG. 11 is a conceptual diagram showing how the polarity of display signals for one scanning line is changed in a conventional driving method.
Figure 12A:
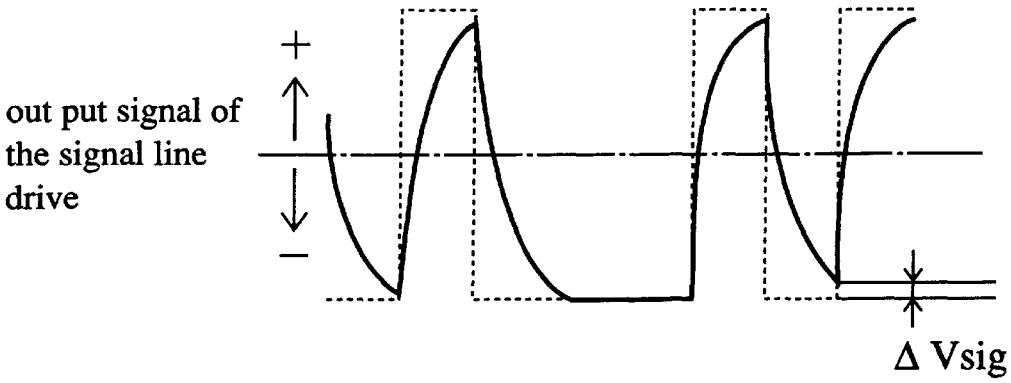
FIG. 12A ( PRIOR ART )
FIGS. 12A and 12B show signal waveforms of the driving method in the conventional liquid crystal display device.
Figure 12B:
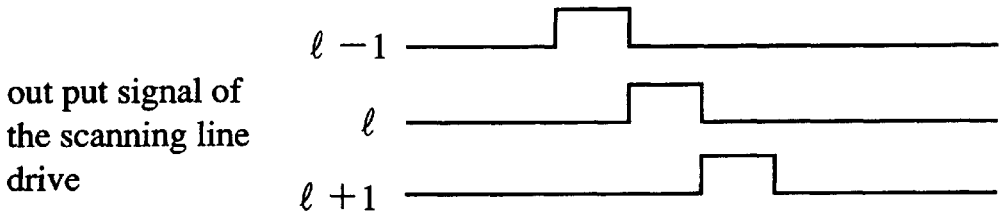
FIG. 12B ( PRIOR ART )

FIGS. 9A and 9B show a signal line driver output signal and scanning line driver output signals, respectively, according to a fourth embodiment of the invention. The fourth embodiment is different from the second embodiment in that an antiferroelectric liquid crystal (AFLC) or a ferroelectric liquid crystal is used as a liquid crystal material. The drive waveforms of FIGS. 9A and 9B are intended for use in a case where display signals to be written have a waveform in which the polarity is continuous, that is, is not inverted, for all scanning lines except one scanning line per field as in the case of the second embodiment, and the write time for the polarity inversion scanning line (one per field) is set longer than for the other scanning lines. The feature that the write time for the lth line (polarity inversion line) is set longer than the (l−1)th and (l+1)th lines is the same as in the third embodiment.

Signal waveform distortion due to a high output impedance of the signal line driver can be prevented from causing adverse effects by inserting an intermission period t4 immediately after display signals have been written to the pixels of the polarity inversion scanning line as shown in FIGS. 9A and 9B. Therefore, luminance reduction due to signal amplitude decrease that conventionally occurs between the polarity inversion line and the next line ((l+1)th line) can be prevented.

The display signal delay circuit 6 and the scanning signal delay circuit 5 of FIGS. 6 and 7 can still be used for the case where the write time is varied as shown in FIGS. 9A and 9B. That is, as for a display signal, the delay of the delay circuit 34 of the display signal delay circuit 6 may be set at a time that is an intermission period t4 plus an elongated portion of the write time. As for a scanning signal, the delay of the delay circuit 54 of the scanning signal delay circuit 5 may be set at a time that is the intermission period t4 plus the elongated portion of the write time. By using such delays, high-quality display images can be obtained.

In the driving schemes according to the third and fourth embodiments in which an antiferroelectric liquid crystal (AFLC) or a ferroelectric liquid crystal is used, to prevent insufficient writing, a control is so made that the write time for the polarity inversion line is made longer than for the other lines. Similar results can be obtained by setting the voltages of display signals for the polarity inversion line higher than for the other lines.

What is claimed is:

1. A liquid crystal display device comprising:

a plurality of signal lines and a plurality of scanning lines that are arranged in lattice form;

pixel electrodes that are arranged in matrix form at crossing portions of the signal lines and the scanning lines, a display voltage being written to each of the pixel electrodes from one of the signal lines electrically connected thereto in a display voltage writing state that is established when a corresponding one of the scanning lines is selected;

an counter electrode that is opposed to the pixel electrodes;

a liquid crystal layer provided between the pixel electrodes and the counter electrode;

a signal line driver for sequentially transferring display voltages having alternate polarities to the signal lines;

a scanning line driver for selectively driving the scanning lines to thereby allow display voltages to be written to part of the pixel electrodes corresponding to a selected scanning line; and control means for causing, when a polarity of display voltages to be supplied to a particular one of the signal lines in one field or frame is opposite to a polarity of display signals that were supplied to the same signal line in a preceding field or frame, the signal line driver to supply display voltages to pixel electrodes corresponding to a next signal line after inserting a dummy cycle having a predetermined interval.

2. The liquid crystal display device according to claim 1, wherein the predetermined interval is shorter than a time constant of an output impedance of the signal line driver and a parasitic capacitance of one of the signal lines.

3. The liquid crystal display device according to claim 1, wherein the liquid crystal layer is one of a ferroelectric liquid crystal layer and an antiferroelectric liquid crystal layer, and wherein a display voltage writing time for the particular scanning line is longer than that for the next scanning line.

4. The liquid crystal display device according to claim 1, wherein the liquid crystal layer is one of a ferroelectric liquid crystal layer and an antiferroelectric liquid crystal layer, and wherein an absolute value of the display voltages for the particular scanning line is larger than that for the next scanning line.

5. The liquid crystal display device according to claim 1, wherein the control means comprises:

a scanning signal delay circuit for supplying a scanning signal to the scanning line driver;

a display signal delay circuit for supplying a display signal to the signal line driver; and a display timing controller for supplying a scanning signal and a delay signal selection control signal to the scanning signal delay circuit, supplying a display signal and the delay signal selection control signal to the display signal delay circuit, supplying a scanning output prohibition signal to the scanning line driver, and supplying a display polarity inversion control signal to the signal line driver.

6. The liquid crystal display device according to claim 5, wherein the display signal delay circuit comprises a delay circuit and a selection circuit connected to and provided downstream of the delay circuit.

7. The liquid crystal display device according to claim 5, wherein the scanning signal delay circuit comprises a parallel connection of a delay circuit and a latch circuit, and a selection circuit connected to and provided downstream of the parallel connection of the delay circuit and the latch circuit.

* * * * *